United States Patent [19]

Verbruggen

[11] Patent Number: 4,708,450

[45] Date of Patent: Nov. 24, 1987

[54] APPARATUS AND METHOD OF DIFFUSION TRANSFER PROCESSING

[75] Inventor: Herman F. Verbruggen, Zandhoven, Belgium

[73] Assignee: Agfa-Gevaert N.V., Mortsel, Belgium

[21] Appl. No.: 916,176

[22] Filed: Oct. 7, 1986

[30] Foreign Application Priority Data

Oct. 14, 1985 [EP] European Pat. Off. ... EP85201679.9

[51] Int. Cl.[4] ..... G03D 9/00; G03D 5/06

[52] U.S. Cl. ..... 354/303; 354/305; 354/318

[58] Field of Search ..... 354/301, 303, 305, 317, 354/318

[56] References Cited

U.S. PATENT DOCUMENTS

| | | | |
|---|---|---|---|
| 3,142,241 | 7/1964 | Limberger | 354/301 |
| 3,202,072 | 8/1965 | Limberger | 354/303 |
| 3,418,912 | 12/1968 | Land et al. | 354/318 |

*Primary Examiner*—A. A. Mathews

*Attorney, Agent, or Firm*—William J. Daniel

[57] ABSTRACT

Apparatus for processing sheet material according to the DTR process, with two liquid applicator rollers (17,18) that are arranged for wetting one side only of each sheet, and with a liquid transfer roller (16) that is arranged for rotation in a tray (14) with processing liquid (15), said rollers being mounted in such a way that there are maintained beads (20,21,22) of processing liquid between either pair of these three rollers, in operation of the apparatus.

23 Claims, 6 Drawing Figures

APPARATUS AND METHOD OF DIFFUSION TRANSFER PROCESSING

DESCRIPTION

The present invention relates to an apparatus for processing photographic material according to the peel-apart diffusion transfer process, hereinafter called the DTR-process, which apparatus comprises means for transporting and guiding image-wise exposed and image receiving webs along paths in a forward direction, means for applying processing liquid to a first face of each web at locations where their paths are separate, guide means for causing said paths to become contiguous and squeegee rollers for urging the wetted first faces of the webs into intimate contact to initiate diffusion transfer. The invention also relates to a method of diffusion-transfer processing web material comprising advancing and guiding image-wise exposed and image receiving webs along paths in a forward direction, applying processing liquid to a first face of each web while their paths are separate, bringing said first web faces into contact and causing said webs to follow contiguous paths, and urging the wetted first faces of the webs into intimate contact to initiate diffusion transfer.

The DTR-process as referred to herein not only includes the silver complex diffusion transfer process for producing black-and-white images but also any dye diffusion transfer process for producing dye images.

In the silver complex diffusion transfer-process, silver complexes are image-wise transferred by diffusion from a silver halide emulsion layer to an image-receiving layer, where they are converted, optionally in the presence of development nuclei, into a silver image. For this purpose, an image-wise exposed silver halide emulsion layer is developed by means of a developing substance in the presence of a so-called silver halide solvent. In the exposed parts of a negative silver halide emulsion layer the silver halide is developed to silver so that it cannot dissolve any more and consequently cannot diffuse. In the non-exposed parts of the silver halide emulsion layer the silver halide is converted into soluble silver complexes by means of a silver halide complexing agent (a so-called silver halide solvent) and transferred by diffusion to an adjacent image-receiving layer or to an image-receiving layer brought into contact with the emulsion layer to form, usually in the presence of development nuclei, a silver, or silver-containing, image in the image-receiving layer. By the use of a negative silver halide material a positive silver image is obtained in the image-receiving material. More details can be found in "Photographic Silver Halide Diffusion Processes" by A. Rott and E. Weyde. Focal Press London, New York (1972).

In the practical operation of the process, a light-sensitive material is exposed either in contact or in a camera to an original, and then the exposed material is transported together with the receptor material through a one-solution processing unit. The sheets are pressed onto each other at the outlet of the unit to start the diffusion transfer. Finally, the sheets are separated after some tens of seconds, and the copy is ready.

Dye diffusion transfer processes operate in a similar way. When an exposed light-sensitive sheet is pressed against a receptor sheet, diffusible dyes that are released image-wise upon development, diffuse to the receptor sheet to form a dye image thereon.

A survey of such processes is given by Christian C. Van de Sande in Angew.Chem.Int.Ed.Engl. 22 (1983) 191–209.

One example of a processing apparatus for DTR materials is disclosed in French patent Specification No. 1 374 801. That Specification discloses a process and appparatus in which the two sheets to be processed are fed together with their sensitive sides facing away from one another to opposite sides of a pair of pressure rollers. The sheets are guided back around the pressure rollers, in course of which movement their sensitive sides are wetted using lick rollers, and fed back to follow a reflex course between the nip of the pressure rollers to urge their sensitive sides into intimate contact to initiate diffusion transfer.

Apparatus of the described type offers satisfactory results for the production of simple photocopies for example of typescripts although this application has become obsolete because such copying is now being carried out in an electrophotographic way.

A disadvantage of such known processing apparatus that operates with lick rollers, is that in order to prevent jamming, guide means must be provided which enters into sliding contact with the sensitive sides of the sheets in order to properly convey the sheets towards the pressure rollers at the outlet end of the apparatus. As a result of this, there is a risk that the sensitive side of one or other sheet will be damaged with consequent loss of image quality, and in more delicate applications of the DTR-process such defects in the final image are unacceptable. Examples of such delicate applications are the production of screened proofs, intermediate orginals for paste-ups, intermediate copies for photomechanical processes, etc.

It is an object of the present invention to provide an improved apparatus for the processing of photographic material according to the DTR process, which is economical in use of processing liquid, and which is suited for the handling of material for more delicate applications.

According to the present invention, there is provided apparatus for processing web material according to the DTR process, which apparatus comprises means for transporting and guiding image-wise exposed and image receiving webs along paths in a forward direction, means for applying processing liquid to a first face of each web at locations where their paths are separate, guide means for causing said paths to become contiguous and squeegee rollers for urging the wetted first faces of the webs into intimate contact to initiate diffusion transfer, which is characterised in that such liquid applying means comprises a pair of rollers disposed between the web paths for applying processing liquid to said first web faces while those faces are in facing relationship, and drive means for the liquid applicator rollers for driving them in counter-rotation so that their peripheries move in the rearward direction where they meet the web paths.

The invention includes a method of diffusion-transfer processing web material comprising advancing and guiding image-wise exposed and image receiving webs along paths in a forward direction, applying processing liquid to a first face of each web while their paths are separate, bringing said first web faces into contact and causing said webs to follow contiguous paths, and urging the wetted first faces of the webs into intimate contact to initiate diffusion transfer, characterised in that such liquid is applied to said first web faces while those faces are in facing relationship, by means of a pair of rollers which are disposed between the web paths and driven in counter-rotation so that their peripheries move in the rearward direction where they meet the web paths.

The term "web" as used in the present statements of invention, and also further through the specification, includes sheets as well as notably longer lengths of material.

The use of such apparatus and method presents important practical advantages in DTR processing, in particular as regards the quality of the transferred image. Wetting of the sensitive first faces of the material being processed by counter-rotating lick rollers gives a particularly uniform and economical application of processing liquid. Because the sensitive faces of the material are facing when they are wetted, those faces of the webs do not require to be bent convexly to bring them into mutual contact and there is accordingly less risk that those faces, or the uniform coating of processing liquid on those faces, and more particularly trailing portions of those faces, will be damaged by contact with parts of the apparatus used.

Indeed in the most preferred embodiments of the invention, the space between the converging web paths and forward of the applicator rollers is clear. In this way, the only part of the apparatus that can be contacted by a sensitive web face after wetting will be the lick roller for applying processing liquid to the other web. Even if this should occur, it is not a serious disadvantage because that roller is itself wet, so that marring of the sensitive web face or the layer of processing liquid thereon will be minimal.

Preferably, between said applicator rollers and the zone where the web paths become contiguous, those paths are substantially rectilinear. It has been found that causing the webs to follow substantially rectilinear paths after wetting to the zone where the webs come into contact reduces and can substantially eliminate undesirable deviations of the webs from their intended paths, and the uniformity of transport of successive webs is excellent so that the reproducibility of the wet processing is correspondingly high.

Advantageously, the angle between said web paths forward of said applicator rollers is always less than 60°. In the most preferred embodiments of the invention, that angle is always less than 40°. By keeping that angle small, changes in direction of one or both of the webs as they come into contact to follow contiguous paths are kept small and this permits a smooth accommodation of the webs to one another as they meet. It is also important for lengthwise registration of the webs. Generally speaking, it is desirable for one web to lead the other by a few millimeters, so that they may be separated easily after the completion of diffusion transfer. Such lead distance is not critical, but it is usually kept less than ten millimeters so as to avoid an intolerable displacement of the image. It is however desirable that such lead distance should be accurately predictable, and this implies that it must be reproducible. Reproducibility is promoted when the angle between the web paths where they come into contact is small.

Preferably, between the first of said transport means and the nip of said squeegee rollers, the path of neither of said webs changes direction by a total of more than 60°. This simplifies guiding of the webs and reduces any risk of damaging their sensitive surfaces.

In preferred embodiments of the invention, between the first of said transport means and the nip of said squeegee rollers, the paths of both of said webs are always inclined to the vertical by more than 60°. This implies a generally horizontal conveyance through the processing apparatus, and this simplifies its construction and use.

Advantageously, there is a common transfer roller for supplying liquid to both said applicator rollers which is closely spaced from such applicator rollers for the maintenance of a bead of processing liquid between the transfer roller and each applicator roller. This promotes a uniform application of processing liquid to the web faces.

In such embodiments, it is preferred that a said applicator roller for the lower path is located forwardly of the transfer roller, a said applicator roller for the upper path is located above the transfer roller and the lower path applicator roller, and the transfer roller is arranged to rotate so as to transfer liquid to the upper path applicator roller before the lower path applicator roller. This implies that the transfer roller is arranged to counter-rotate with respect to the web following the lower path. It is found that with this arrangement, there is less likelihood that any excess processing liquid which may be picked up by the transfer roller will splash down onto the lower web, so giving rise to a risk of uneven image transfer.

Uniformity of application of the processing liquid is further promoted when said applicator rollers are closely spaced from each other for the maintenance of a bead of processing liquid between them, as is preferred.

It is especially preferred that one of the web paths is substantially rectilinear between the applicator roller on that path and the nip of said squeegee rollers. Causing one of the wetted webs to follow a path which is substantially rectilinear at least until diffusion transfer is initiated allows that web to be transported with guide means bearing only on one of its faces. It is advantageous for the lower of the webs to follow such a rectilinear path (when the webs are transported one above the other) so that the wetted sensitive face of that web need have no contact with any guide means. It is also desirable for the image bearing web to follow such a lower path, since its sensitive face is in general more easily damaged than that of the image receiving web. Such web path may be, and preferably is, substantially rectilinear between the first of said transport means on that path and the nip of said squeegee rollers.

It is preferred that a guide plate is provided for supporting webs following contiguous paths to said squeegee rollers, and that said web paths converge at a location where one of them is supported by said guide plate, since this allows good support of the webs where they first come into contact. Said guide plate may be provided with ribs for reducing the contact area with the web which is supported thereon, and with openings between the ribs for the rapid evacuation of liquid that may occasionally leak from the supported sheet.

Construction and operation of the apparatus are simplified when, as is preferred, said liquid applying means comprises transfer roller means for supplying processing liquid to said applicator rollers from a common liquid supply tray located between said paths.

A preferred embodiment of the apparatus according to the invention will hereinafter be described by way of example with reference to the accompanying drawings wherein.

Figure 1:
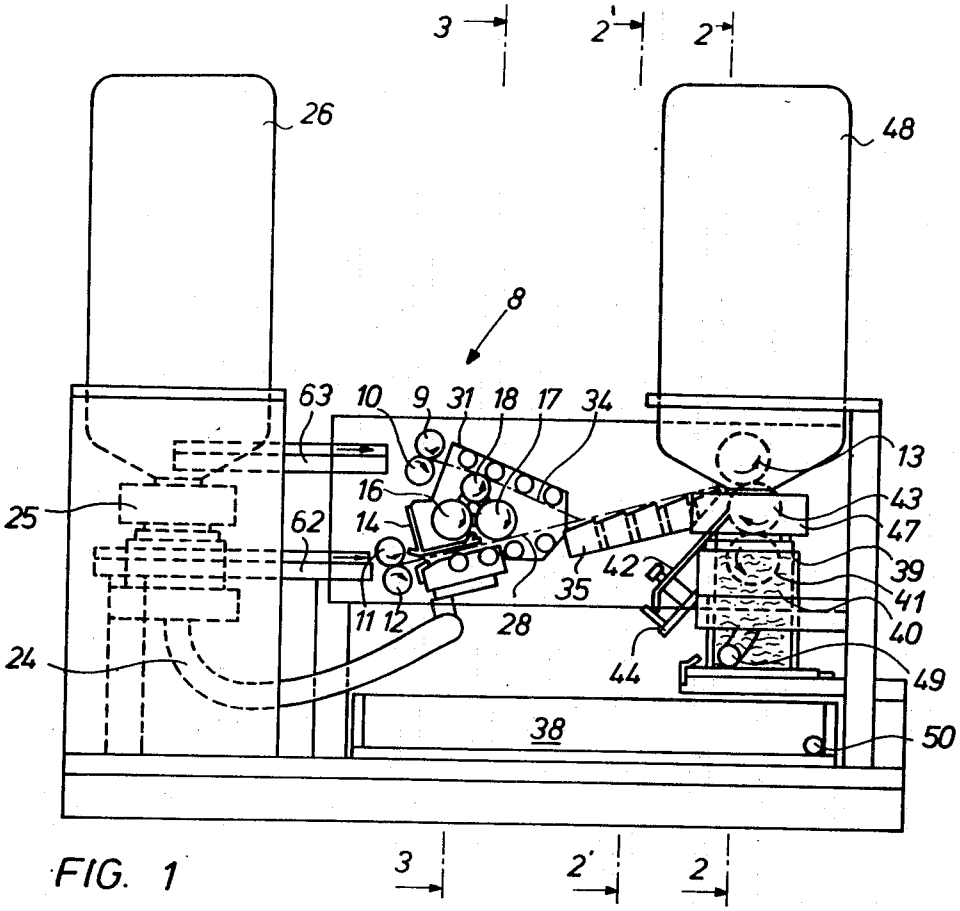
FIG. 1 is a longitudinal sectional view of one embodiment of an apparatus according to the present invention.
Figure 5:
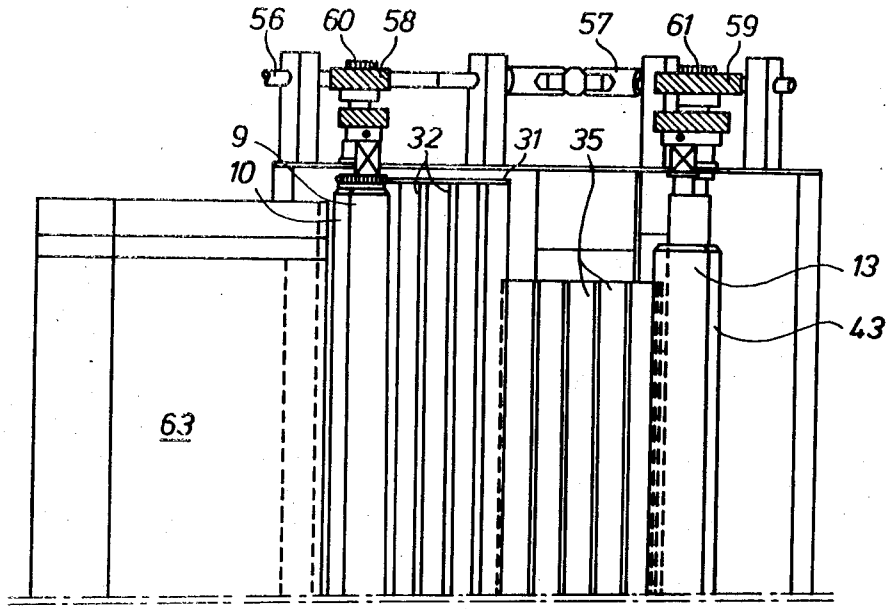
FIG. 5 is a top view illustrating the driving of the transport rollers.

Referring to FIG. 1, and also FIG. 5, the apparatus comprises a housing 8 with pairs of inlet transport rollers 9,10 for one sheet and 11,12 for the other sheet, and squeegee rollers 13, 43 for the removal of the sheets from the apparatus.

The processing section comprises a tray 14 with processing liquid 15, a liquid transfer roller 16 that rotates partially immersed in the liquid, and liquid applicator rollers 17 and 18 which are mounted at such distance from the liquid supply roller and from each other, that in operation of the apparatus beads of processing liquid 20, 21 and 22 are established and maintained between the adjacent roller surfaces. The liquid level 23 in the tray is controlled via a conduit 24 by a bird-fountain control 25 onto which a supply bottle 26 of processing liquid is screwed.

The bottom wall 27 of the tray 14 has an inclination in conformity with the path 28 of the lower sheet through the apparatus, and the rear wall 29 of the tray has an inclination and a height such that it closely fits between the transfer roller 16 and the liquid applicator roller 17.

Figure 3:
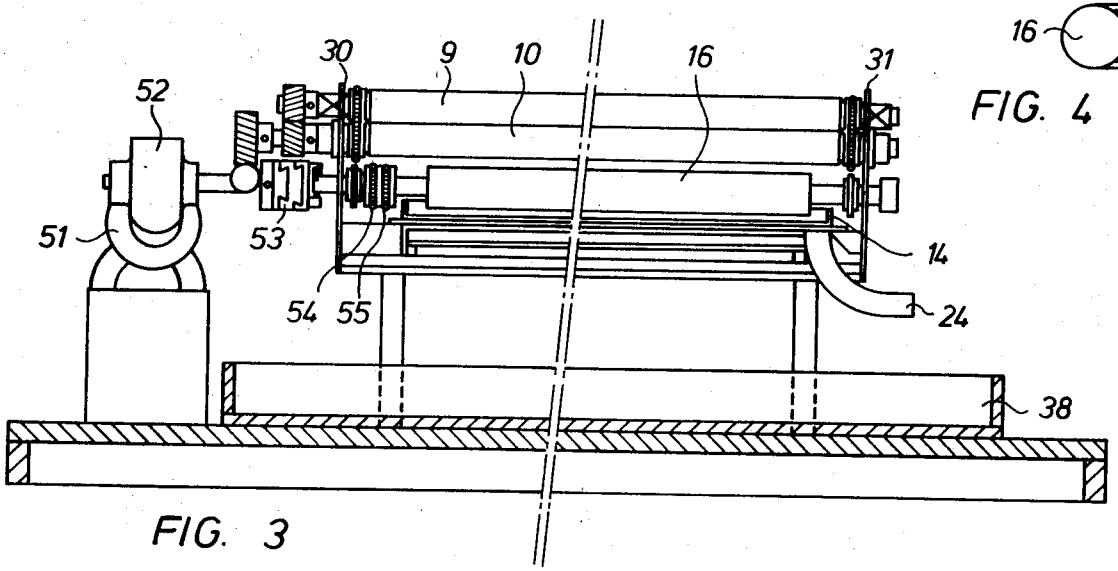
FIG. 3 is a section on line 3—3 of FIG. 1.

The three rollers 16, 17 and 18 for the processing liquid are rotatably mounted between two flanges 30 and 31, see also FIG. 3, which are interconnected by two series of parallel rods 32 and 33 which determine the paths 28 and 34 for the corresponding sheets by the sliding contact of their surfaces with the reverse side of the sheets.

The contiguous paths of the converged sheets are further determined by a guide plate 35 which determines sheet paths corresponding with the path 28, and that in fact is tangent to the nip of the rollers of the inlet roller pair 11,12, and also to the nip of the rollers of the squeegee roller pair 13,43. The guide plate 35 has transverse ribs 36 whereby the frictional contact with the lower sheet is reduced, and a plurality of small slots 37 through which liquid that may drain from the sheets is received in a pan 38.

Figure 2:
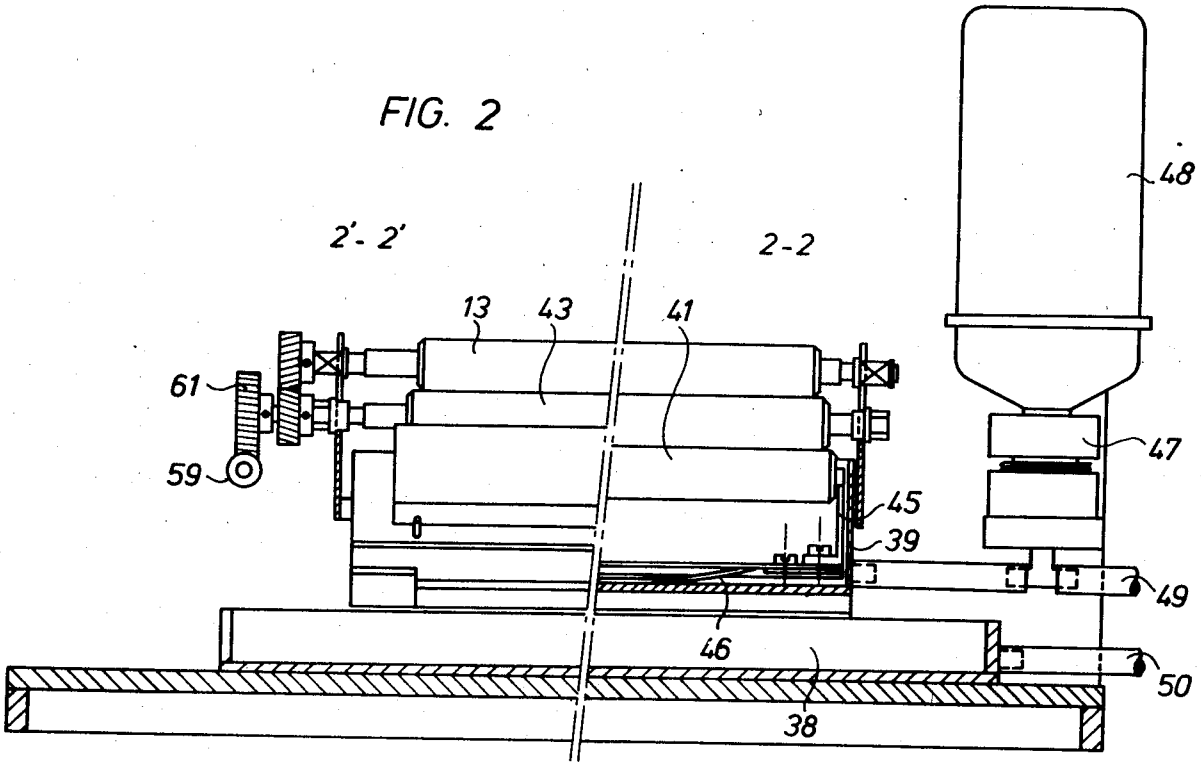
FIG. 2 is a section on line 2—2 and on line 2'—2' of FIG. 1.

The squeegee roller pair 13,43 is provided with means for keeping the rollers clean. Said means comprises a small tank 39 with cleaning liquid 40, an applicator roller 41 that dips into the liquid and a flexible trailing wiper blade 42 that is mounted on a support 44 and which gently engages with its free edge the peripheral surface of the roller 43. The applicator roller 41 is driven by the frictional contact with the roller 43, and to this end the roller 41 is mounted in a yoke 45, see the section 2—2 in FIG. 2, which is vertically movable in the tank 39 and that is spring-biased by a leaf spring 46. The liquid in the tank is maintained at a constant level through a bird-fountain control 47, and the liquid is supplied from a bottle 48. The tank 39 and the pan 38 are provided with flexible hoses 49 and 50, which may be provided with appropriate valves, or the free ends of which may be folded back and closed by an appropriate clamp, and that serve for the emptying of the tank, respectively the pan.

Figure 4:
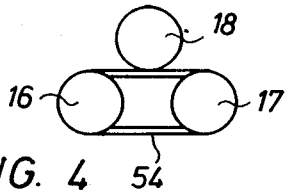
FIG. 4 is a detail of FIG. 1, illustrating the driving of the liquid applicator rollers.
Figure 6:
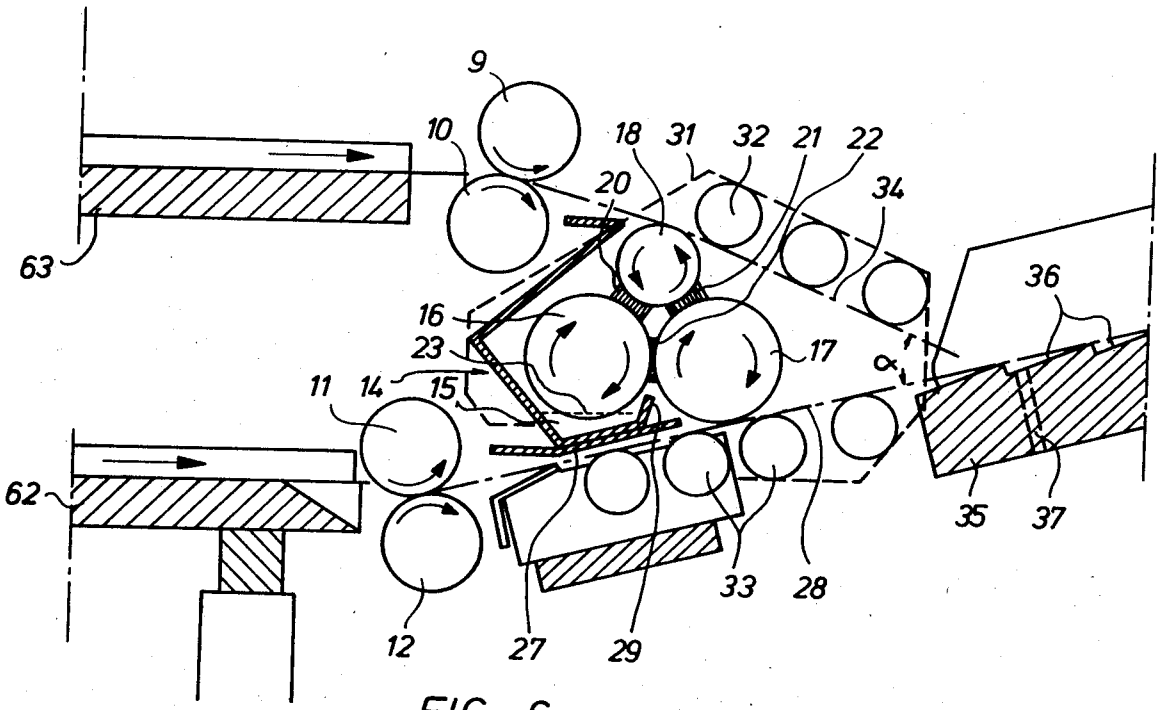
FIG. 6 is an enlarged view of the processing section of the apparatus according to FIG. 1.

The driving of the several rollers of the apparatus occurs through two motors. A first motor 51, see FIG. 3 drives the transfer roller 16 through an inbuilt reduction gear 52 and a clutch 53. The roller 16 is coupled with the liquid applicator roller 17 through two parallel rubber belts 54 and 55, running in corresponding pulleys on the roller shafts, whereas the driving of the upper liquid applicator roller 18 occurs through frictional contact of a lower zone of the roller periphery with the upper stretch of the belts 54 and 55 between the rollers 16 and 17, see FIG. 4, In this way the directions of rotations of the rollers as illustrated in FIGS. 1 and 6 are obtained. The clutch 53 comprises interfitting portions which allow the vertical disengagement of the shaft of the roller 16 from the driving motor, for the removal of the processing section from the apparatus for maintenance purposes.

The driving of the sheet transport rollers occurs through a second motor, not illustrated, which drives driving shafts 56 and 57, see FIG. 5. The shafts are provided with worms 58 and 59 which are in engagement with corresponding worm wheels 60 and 61 fitted to a corresponding one of the pairs 9,10 and 13,43 of rollers. The roller pair 11,12 is driven by the worm 58 via a worm wheel (not illustrated) that is provided on the shaft of the roller 11.

The processing solution applied in the apparatus and method of diffusion transfer processing may be any processing liquid used in the well-known silver halide complex diffusion transfer process for which reference is made e.g. to the book: "Photographic Silver Halide Diffusion Processes" of André Rott and Edith Weyde—Focal Press—London—New York (1972).

According to a preferred embodiment the processing liquid is an alkaline aqueous liquid used in combination with photographic silver halide emulsion materials incorporating already (a) developing agent(s).

In order to increase the wetting capacity of the processing liquid it contains preferably wetting agents (coating aids), e.g. of the type disclosed in U.S. Pat. No. 3,769,022 and compounds such as

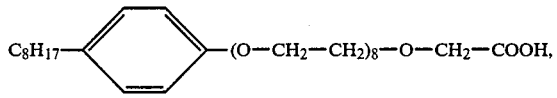

further fluorinated wetting agents, e.g. mixtures of the ammonium salts of perfluorocarboxylic acids, e.g. the ammonium salt of perfluorocaprylic acid and $F_3C(CF_2)_6CONH(CH_2CH_2O)_{\pm 17}$—H.

The processing liquid preferably also contains a thickening agent preventing an adherent deposition of processing liquid ingredients on the rollers at the interface of the liquid with the air in stand-by position. A particularly suited thickening agent for that purpose is polyacrylamide.

The operation of the apparatus is as follows: the bottle 26 is filled with an appropriate processing solution, and the bottle 48 is filled with a rinsing liquid, e.g. water. The rollers of the wet processing section are put into rotation, the processing liquid being at room temperature, or at a more elevated temperature which preferably is thermostatically controlled.

A light-sensitive DTR sheet is placed on the lower entry plate 62, with the light-sensitive side which has been image-wise exposed facing upwardly, and advanced until the leading edge abuts against the nip of the inlet transport roller pair 11,12.

A receptor DTR sheet is placed on the upper entry plate 63, with the image-receiving side of the sheet facing downwardly. The sheet is likewise advanced until abutment with the corresponding inlet transport roller pair 9,10.

Then, while the contact of the sheets with the corresponding entry rollers is maintained, the drive of the apparatus is switched on so that the transport of the sheets through the apparatus is started.

The sheets follow the paths 28 and 34, and become uniformly wetted with processing liquid at their mutually facing sides by the contact with the corresponding liquid applicator roller. The counter-rotation of the applicator rollers has the effect that a very uniform layer of processing liquid having a very limited thickness is applied to the sheets.

It is clear that the thickness of the applied layer of processing liquid depends on several factors as there are: viscosity, surface tension and temperature of the processing liquid, peripheral velocity and surface structure of the lick rollers.

The light-sensitive sheet continues its path over the guide plate 35 whereas the receptor sheet enters in contact with the light-sensitive sheet at a point where the light-sensitive element is already supported by the guide plate 35. The contact between both sheets should occur at an angle as small as possible, since in this way the receptor sheet shall accommodate itself in the quickest and smoothest way to the path followed by the light-sensitive sheet. In the present apparatus, the angle Alpha between the paths 28 and 34 mounted to only 37.5°. The fact that this angle can be so small is a direct consequence of the compactness of the wet processing section which requires but a limited space between the two sheets. The linear paths of the sheets towards the zone of mutual contact between the sheets ensures a very steady and uniform advance of the sheets under the control of the inlet roller pairs.

Occasional excess of liquid that adheres to the sheets, and also liquid that flows back by the squeezing action of the squeegee rollers 13 and 43, flows through the slots 37 and drips in the pan 38. The squeegee rollers 13 and 43 firmly urge the sheets onto each other whereby the diffusion transfer process is started.

After the sandwich of both sheets has left the apparatus, it is left untouched for a given period until the diffusion transfer is complete. Then the two sheets are peeled apart. This operation may be facilitated if the light-sensitive sheet leads or trails the receptor sheet by a distance of some millimeters. This can easily be achieved by making the path of the light-sensitive sheet from the inlet rollers to the squeegee rollers slightly shorter or longer than the corresponding path of the receptor sheet.

Finally, the receptor sheet may be dried in a dryer.

The inlet transport and squeegee rollers of the apparatus may continue to be driven for a short period of time after the discharging of the sheets, in order to give the cleaner roller 41 the opportunity to apply rinsing liquid to, and thereby clean the outlet squeegee rollers. The mentioned prolonged rotation of the driving rollers may occur under the control of a suitable microprocessor.

The rotation of the rollers of the wet processing section is preferably arrested after the sheets have left the apparatus in order to limit the exposure of the processing liquid to atmospheric oxygen. However, in order to avoid crystallisation effects of the liquid on the rollers, the rollers may be periodically put into rotation according to a suitable jogging cycle, preferably also under microcomputer control.

The following data pertain to the embodiment of the apparatus which has been described hereinbefore.

| | |
|---|---|
| Sheet format: | A4 |
| Transport speed of the sheets: | 2 $cm.s^{-1}$ |
| Peripheral velocity of the rollers 16, 17 and 18 | 2 $cm.s^{-1}$ |
| Contents of bottles 26 and 48: | 1.0 l |
| Consumption of processing liquid per sandwich: | 10 ml |
| Liquid removed by squeezing rollers 13, 43: | 6 ml |
| Mantle of rollers 9, 12, 13 and 43: | rubber |
| Mantle of rollers 10, 11, 16, 17, 18 and 41: | stainless steel smooth peripheral surface |
| Gap between the rollers 16, 17 and 18: | 0.15 mm |
| Diameter of the rollers 16 and 17: | 20 mm |
| Diameter of the roller 18: | 15 mm |
| Length of the rollers: | 300 mm |

If it is desired to build an apparatus for DTR processing sheets of a larger format than A4, the rollers would clearly require to be longer than 300 mm. The wet processing rollers 16,17,18 would also require to be of greater diameter in order to prevent flexure.

In practice, it was found that approximately 100 dye diffusion transfers could be made with one liter of processing liquid, and this with a consistent quality. This production volume is impossible with the conventional apparatus for diffusion transfer, wherein the sheets are dipped into the processing liquid contained in a larger tray, and wherein the quality of the diffusion transfer deteriorates much more rapidly.

The described test was carried out by means of materials and processing solutions as used in the COPYCOLOR (trademark of Agfa-Gevaert, Antwerp, Belgium) system for making full colour enlargments or reductions from any coloured original such as: colour prints, line work, photographic transparencies, drawings, etc. In the present example the light-sensitive sheet was a COPYCOLOR CCN film, i.e. a panchromatic negative film for camera and enlarger, to be processed in low-level yellow safety light. This 0.10 mm polyester film is provided with an antihalation coating. The receptor sheet was a COPYCOLOR CCP sheet, i.e. a polyethylene coated paper of a weight of 100 g/sq.m, semi-matt on both sides.

The images of the sheets produced in the apparatus according to the invention were completely free from transverse streaks and zones of slight discoloration, which are typical defects caused by the prior art processors wherein the sheets are fed through a tray of processing liquid along curved paths which extend between the inlet and outlet rollers.

The apparatus according to the invention can be used with success in the production of screened proofs, intermediate originals for paste-ups, and intermediate copies for photomechanical processes, as mentioned already.

The apparatus according to the invention is not limited to the embodiment described hereinbefore.

The apparatus may be incorporated in a larger apparatus which comprises an automatic sheet separator, a rinser and a dryer for the receptor sheet, a collector station for collecting the light-sensitive sheets onto a roll, etc.

The apparatus may be provided with adjustable means for adjusting the leading of one sheet with respect to the other.

The functions of the two motors may be performed by one motor which is coupled through appropriate transmission gears with the different rollers.

The apparatus may be provided with other known means for level control of the liquids in the trays, for controlling their temperatures, for signalling shortage and/or exhaustion of processing liquid etc.

The liquid transfer roller may be wetted with processing liquid by spraying, or by application of liquid through a slot orifice, instead of dipping into a body of liquid.

The apparatus may be operated in such a way that the amount of processing liquid that is applied to the webs is such that no liquid is squeezed from between the webs by the squeegee rollers.

I claim:

1. Apparatus for processing web material according to the DTR process, which apparatus comprises means for transporting and guiding image-wise exposed and image receiving webs along paths in a forward direction, means for applying processing liquid to a first face of each web at locations where their paths are separate, guide means for causing said paths to become contiguous and squeegee rollers for urging the wetted first faces of the webs into intimate contact to initiate diffusion transfer, characterised in that such liquid applying means comprises a pair of rollers (18,17) disposed between the web paths (34,28) for applying processing liquid to said first web faces while those faces are in facing relationship, and drive means (51 to 55) for the liquid applicator rollers (18,17) for driving them in counter-rotation so that their peripheries move in the rearward direction where they meet the web paths.

2. Apparatus according to claim 1, wherein said liquid applying means comprises transfer roller means (16) for supplying processing liquid to said applicator rollers (18,17) from a common liquid supply tray (14) located between said paths (34,28).

3. Apparatus according to claim 1, wherein the space between the converging web paths (34,28) and forward of the applicator rollers (18,17) is clear.

4. Apparatus according to claim 1, wherein between said applicator rollers (18,17) and the zone where the web paths (34,28) become contiguous, those paths are substantially rectilinear.

5. Apparatus according to claim 1, wherein forward of said applicator rollers (18,17) the angle (Alpha) between said web paths (34,28) is always less than 60°.

6. Apparatus according to claim 1, wherein between the first of said transport means (9,10, 11 12) and the nip of said squeegee rollers (13,43), the path (34,28) of neither of said webs changes direction by a total of more than 60°.

7. Apparatus according to claim 1, wherein between the first of said transport means (9,10; 11,12) and the nip of said squeegee rollers (13,43), the paths (34,28) of both of said webs are always inclined to the vertical by more than 60°.

8. Apparatus according to claim 1, wherein there is a common transfer roller (16) for supplying liquid to both said applicator rollers (18,17) which is closely spaced from such applicator rollers (18,17) for the maintenance of a bead (20,22) of processing liquid between the transfer roller (16) and each applicator roller (18,17).

9. Apparatus according to claim 7, wherein a said applicator roller (17) for the lower path (28) is located forwardly of the transfer roller (16), a said applicator roller (18) for the upper path (34) is located above the transfer roller (16) and the lower path applicator roller (17), and the transfer roller (16) is arranged to rotate so as to transfer liquid to the upper path applicator roller (17) before the lower path applicator roller (17).

10. Apparatus according to claim 1, wherein said applicator rollers (18,17) are closely spaced from each other for the maintenance of a bead (21) of processing liquid between them.

11. Apparatus according to claim 1, wherein one of the web paths (28) is substantially rectilinear between the the applicator roller (17) on that path and the nip of said squeegee rollers (13,43).

12. Apparatus according to claim 7, wherein the lower of the web paths (28) is substantially rectilinear between the the applicator roller (17) on that path and the nip of said squeegee rollers (13,43).

13. Apparatus according to claim 11, wherein such web path (28) is substantially rectilinear between the first of said transport means (11,12) on that path and the nip of said squeegee rollers (13,43).

14. Apparatus according to claim 1, wherein a guide plate (35) is provided for supporting webs following contiguous paths (34,28) to said squeegee rollers (13,43).

15. Apparatus according to claim 14, wherein said guide plate (35) is provided with rib-like web supporting extensions (36) and with liquid-draining holes (37).

16. Apparatus according to claim 14, wherein said web paths (34,28) converge at a location where one (28) of them is supported by said guide plate (35).

17. A method of diffusion-transfer processing web material comprising advancing and guiding image-wise exposed and image receiving webs along paths in a forward direction, applying processing liquid to a first face of each web while their paths are separate, bringing said first web faces into contact and causing said webs to follow contiguous paths, and urging the wetted first faces of the webs into intimate contact to initiate diffusion transfer, characterised in that such liquid is applied to said first web faces while those faces are in facing relationship, by means of a pair of rollers (18,17) which are disposed between the web paths (34,28) and driven in counter-rotation so that their peripheries move in the rearward direction where they meet the web paths.

18. A method according to claim 17, wherein said processing liquid is supplied to said applicator rollers (18,17) by transfer roller (16) from a common liquid supply tray (14) located between said paths (34,28).

19. A method according to claim 17, wherein the image-wise exposed web follows the lower path (28).

20. A method according to any of claim 17, wherein liquid is supplied to both said applicator rollers (18,17) froma common transfer roller (16) which is closely spaced from such applicator rollers (18,17), and a bead (20,22) of processing liquid is maintained between the transfer roller (16) and each applicator roller (18,17).

21. A method according to claim 19, wherein the transfer roller (16) is arranged to counter-rotate with respect to the web following the lower path (28).

22. A method according to claim 17, wherein said applicator rollers (18,17) are closely spaced from each other and a bead (21) of processing liquid is maintained between them.

23. A method according to claim 17, wherein the webs are brought into first contact at a location where one of them is supported by a guide plate (35).

* * * * *